US005694918A

United States Patent [19]

Blount

[11] Patent Number: 5,694,918

[45] Date of Patent: Dec. 9, 1997

[54] ASH CATCHER FOR FIREPLACE INSERT

[76] Inventor: Emmitt L. Blount, 103 S. St., LaGrange, N.C. 28551

[21] Appl. No.: 552,082

[22] Filed: Nov. 2, 1995

[51] Int. Cl.[6] ..... F23J 1/00

[52] U.S. Cl. ..... 126/243; 126/242; 126/543

[58] Field of Search ..... 126/543, 555, 126/242, 245, 243

[56] References Cited

U.S. PATENT DOCUMENTS

| | | | |
|---|---|---|---|
| 1,477,930 | 12/1923 | Bartholomew et al. | 126/243 |
| 4,706,648 | 11/1987 | Blount et al. | 126/243 |
| 4,858,536 | 8/1989 | Guest et al. | 126/243 X |

FOREIGN PATENT DOCUMENTS

| | | | |
|---|---|---|---|
| 129259 | 3/1902 | Germany | 126/243 |

*Primary Examiner*—Larry Jones
*Attorney, Agent, or Firm*—Rhodes, Coats & Bennett, L.L.P.

[57] ABSTRACT

The invention herein relates to ash catchers for woodstoves of the type adapted to be inserted into an existing fireplace. The ash catcher includes a generally horizontal pan supported along the front edge by a pair of fixed legs. A third leg is pivotally secured to the pan and is biased to a downward position for supporting the rear edge of said pan. When placed in a position for catching ashes from a woodstove, the rear leg is pivoted upwardly against the underside of the pan which rests upon the fireplace hearth. The ash catcher further includes an attached top for covering the ash pan to prevent ash from spilling when the ash catcher is transported. The ash pan also includes a hinged rear wall that is positionable between closed and open positions. When the ash pan is in the open position, a rear wall opening is formed in the ash pan such that ashes can be swept therefrom.

19 Claims, 4 Drawing Sheets

ASH CATCHER FOR FIREPLACE INSERT

FIELD OF THE INVENTION

The present invention relates generally to accessories for fireplaces and stoves and more particularly to ash pans for removing and disposing of ash.

BACKGROUND OF THE INVENTION

The use of woodstoves for space heating is centuries old. Yet, with the increased costs of operating gas, oil and electric heating systems, the woodstove remains a viable alternative for home space heating. One drawback to woodstoves, however, is the need to periodically remove and dispose of ash.

To facilitate removal and disposal of ash, ash pans have been designed which may be positioned with respect to the woodstove such that ash may be swept therefrom without spilling the same in the area adjacent the stove. One such ash pan is disclosed in the patent to Conner, U.S. Pat. No. 708,162 which is particularly designed for use with a freestanding woodstove. The ash pan of Conner, however, is not well suited for removing ash from woodstoves of the type to be inserted into an existing fireplace.

Another such ash pan is disclosed in the applicant's prior patent issued to Blount et al., U.S. Pat. No. 4,706,648. Applicants have made improvements to the ash pan disclosed in the prior patent that allow an ash pan containing ashes to be more effectively transported and then emptied of ashes.

SUMMARY AND OBJECTS OF THE PRESENT INVENTION

The present invention relates to ash catchers for woodstoves of the type adapted to be inserted into an existing fireplace, which typically includes a ledge extending outwardly over the fireplace hearth. The ash catcher includes a generally, horizontal pan which is supported along the front edge by a pair of fixed legs. A third leg is pivotally secured to the pan and biased to a downward position for supporting the rear of the pan. When placed in a position for catching ashes from the woodstove, the rear leg is folded against the underside of the pan which rests upon the fireplace hearth. The rear wall of the pan slides beneath the ledge of the woodstove. The overhang of the ledge minimizes the amount of ash which may be spilled when sweeping the stove.

The ash catcher further includes an attached top for covering the ash pan to prevent ashes contained in the ash pan from spilling when the ash catcher is moved. The top is moveable to a storage position beneath the ash pan while the ash pan is in use.

To allow for easy removal of ashes from the ash pan, the rear wall is hinged so as to move between a closed position and an open position. When the rear wall is open, ashes can be easily swept out of the ash pan. This eliminates the need for the user to pick-up and invert the ash pan in order to dump the ashes from the pan.

Accordingly, it is an object of the present invention to provide a means for removing ash and other debris from an insert-type woodstove without spilling the same onto the areas adjacent the woodstove.

Another object of the present invention is to provide an ash pan which can be supported by a fireplace hearth with one edge extending underneath the ledge typically found on insert-type woodstoves when in use and can be self-supported when not in use.

Another object of the present invention is to achieve the foregoing objects by providing said ash pan with a pivotally secured leg which can be folded against the underside of said ash pan when the same is rested upon the fireplace hearth, but which automatically assumes a downward, substantially vertical position when said ash pan is removed.

Another object of the present invention is to achieve the foregoing object by providing said ash pan with a pivotally secured leg which can be folded against the underside of said ash pan when the same is rested upon the fireplace hearth, but which automatically assumes a downward, substantially vertical position when said ash pan is removed.

Another object of the present invention is to provide an ash pan that can be transported without spilling ashes.

Another object of the present invention is to provide an ash pan that allows a user to conveniently remove ashes from the ash pan without dumping.

Other objects and advantages of the present invention will become apparent and obvious from a study of the following description and the accompanying drawings which are merely illustrative of such invention.

DETAILED DESCRIPTION OF THE INVENTION

Figure 1:
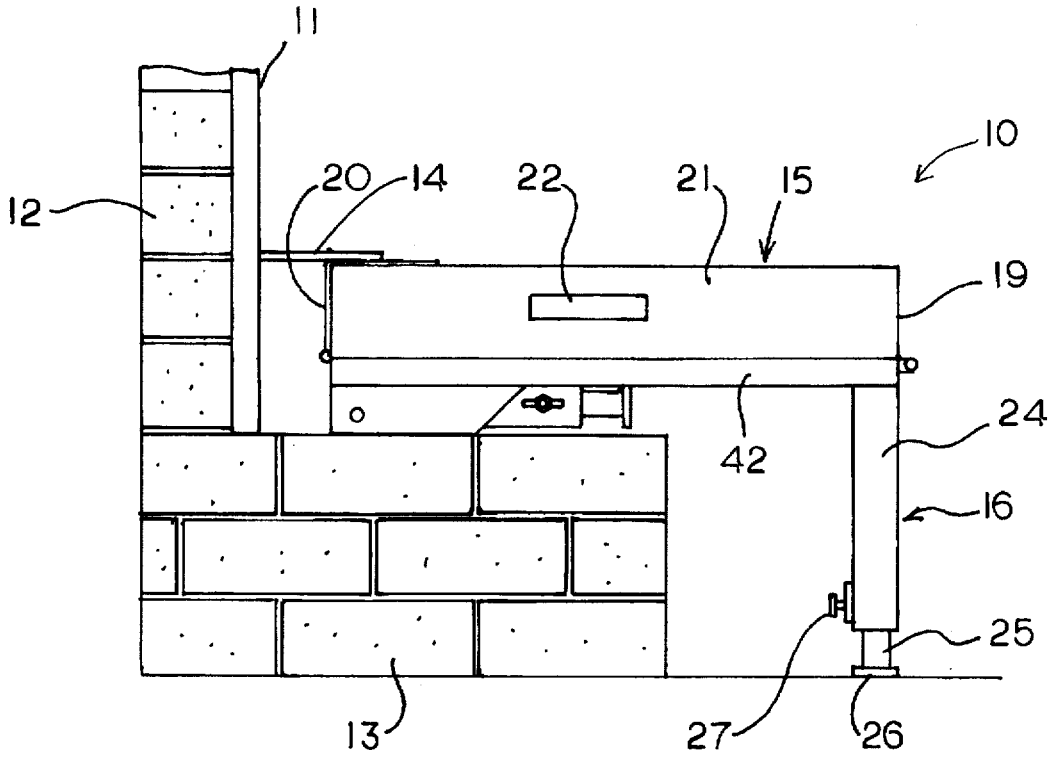
FIG. 1 is a side view of the ash catcher in an ash collection position.

Referring now to the drawings, the ash catcher of the present invention is shown therein and indicated generally by the numeral 10. The ash catcher 10 is designed to be used in connection with a woodstove 11 of the type adapted to be inserted into a fireplace 12. Since woodstoves and fireplaces are well known to those skilled in the art, a detailed discussion of the same is not deemed necessary. However, it is noted that in order to practice the invention claimed herein, the fireplace must be of the type having a raised hearth 13 as is clearly illustrated in FIG. 1. The woodstove 11 in connection with which the present invention is used typically includes a ledge 14 which is best illustrated in FIG. 2, but such is not necessary. Ash catcher 10 is particularly designed to allow for both convenient removal of ashes from woodstove 11 and easy disposal of ashes collected in ash catcher 10.

Turning now to the ash catcher 10, it is seen that the same includes an ash pan indicated generally at 15, a pair of front legs indicated generally at 16 for supporting the front of the ash pan 15, and a pair of rear folding legs indicated generally at 17 for supporting the rear of the ash pan 15.

The ash pan 15 includes a bottom 18 and a surrounding wall structure consisting of a front wall 19, a rear wall 20 and side walls 21. A pair of U-shaped handles 22 are secured to opposite side walls 21 to provide means for lifting and carrying the ash catcher 10 and to facilitate removal of ashes contained therein. The ash pan 15 includes a retractable cover 40 for covering the ash pan 15 when it is moved. The cover 40 is mounted for sliding movement within a pair of tracks 42 mounted to the bottom 18.

The front legs 16 include an upper leg portion 24 secured to the underside of the ash pan 15 at respective front corners. A pair of telescoping, lower leg portions 25 having feet 26 are mounted for sliding movement within corresponding upper leg portions 24 and can be fixed at any desired position by tightening set screw 27 so as to bear against lower leg portion 25. Because the danger of spilling hot ashes on carpet or other flammable materials, it is preferred that the upper leg portions 24 be fixedly secured to the bottom 18 of ash pan 15 to prevent inadvertent collapsing of the ash pan 15 while in use.

Figure 4:
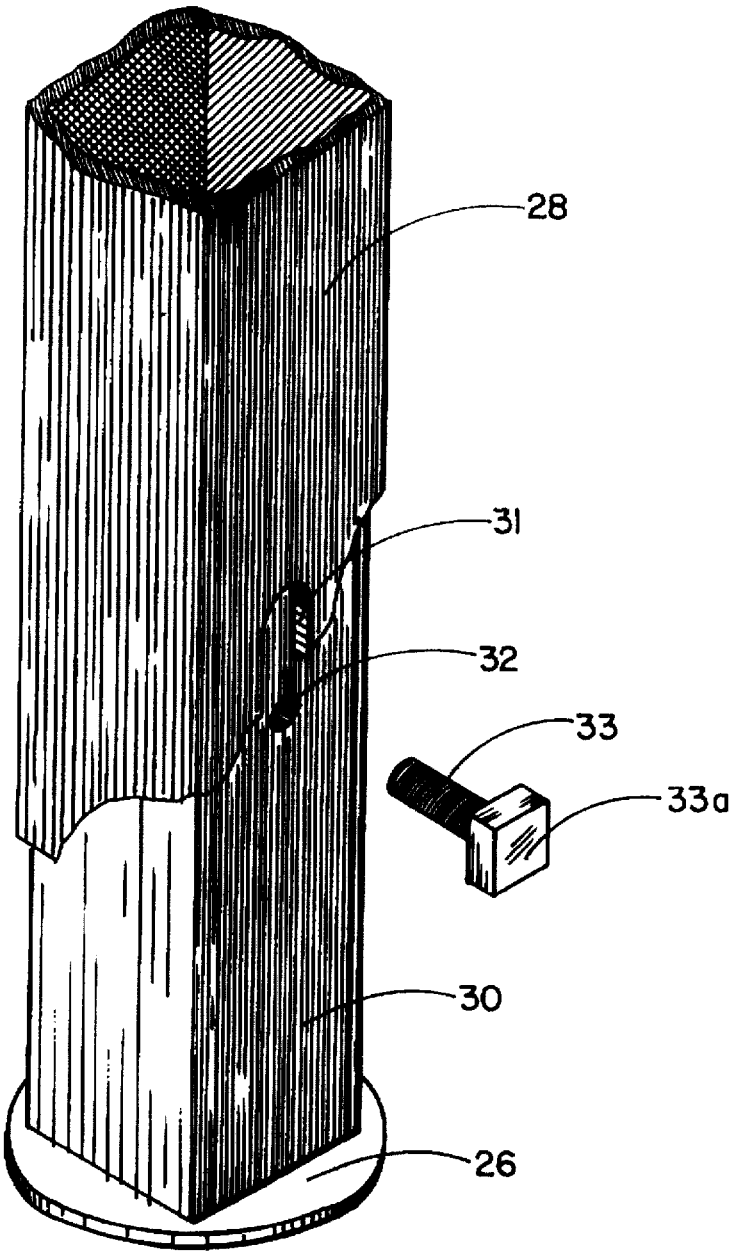
FIG. 4 is a detailed perspective view of the rear leg thereof.
Figure 5:
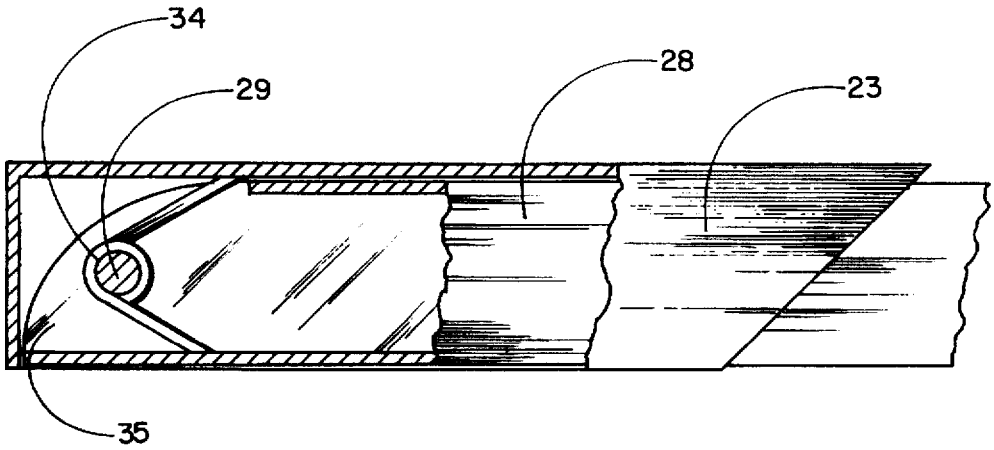
FIG. 5 is a side sectional view thereof with the rear leg in an upward, inoperative position.

The rear legs 17 are mounted to the bottom of respective tracks 42 by means of a channel 23. The channels 23 are secured underneath the bottom 18 of respective tracks 42 on either side of the ash pan and extend perpendicularly from the rear of the ash pan 15 toward the front. The walls of the channel member 23 define a receiving area into which the rear leg 17 is folded as will be described in detail below. The rear legs 17 include an upper leg portion 28 which, unlike front legs 16, are pivotally secured to the channel member 23 by means of a pivot pin 29. A telescoping, lower leg portion 30 is slidably mounted within upper leg portion 28 as can be best seen in FIG. 4. In order to adjust the length of rear leg 17, the upper leg portion 28 is provided with a slot 31 while lower leg portion 30 includes a threaded hole 32 which aligns with slot 31 when the lower leg portion 30 is inserted properly. An adjusting screw 33 extends through slot 31 and is threaded into hole 32 until the head 33*a* of screw 33 bears against the surface of upper leg portion 30. To adjust the length of rear leg 17, screw 33 is loosened so that lower leg portion 30 slides with respect to upper leg portion 28. When the desired length is attained, screw 33 is retightened to fix lower leg portion 30 in place.

Figure 2:
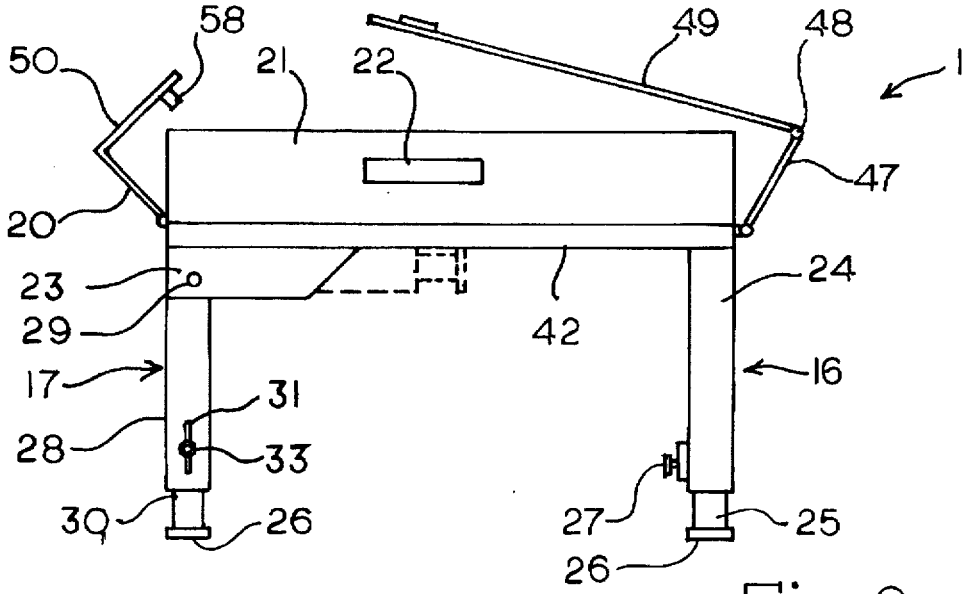
FIG. 2 is a side view of the ash catcher with the rear leg deployed.
Figure 3:
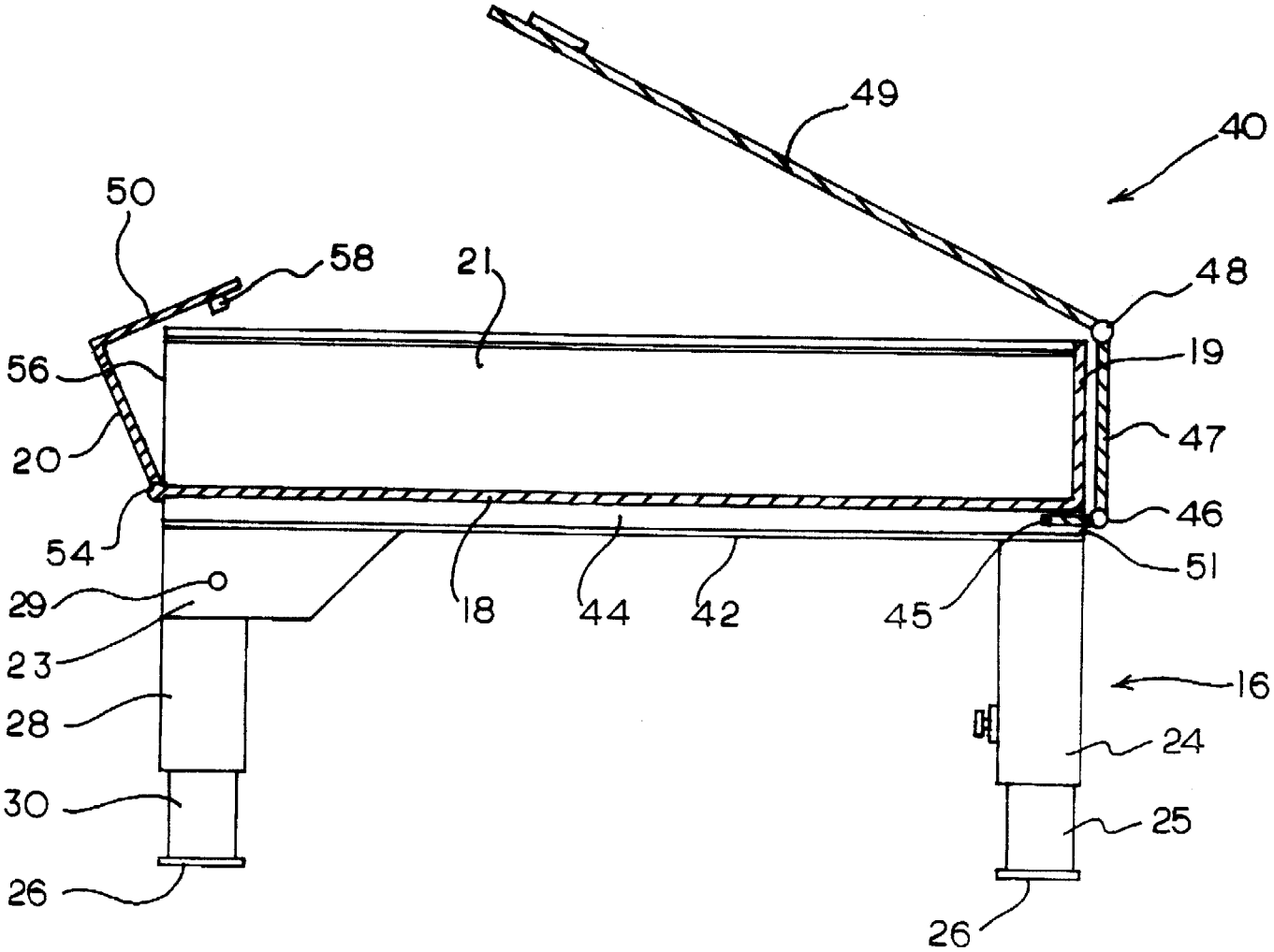
FIG. 3 is a section view of the ash catcher.
Figure 6:
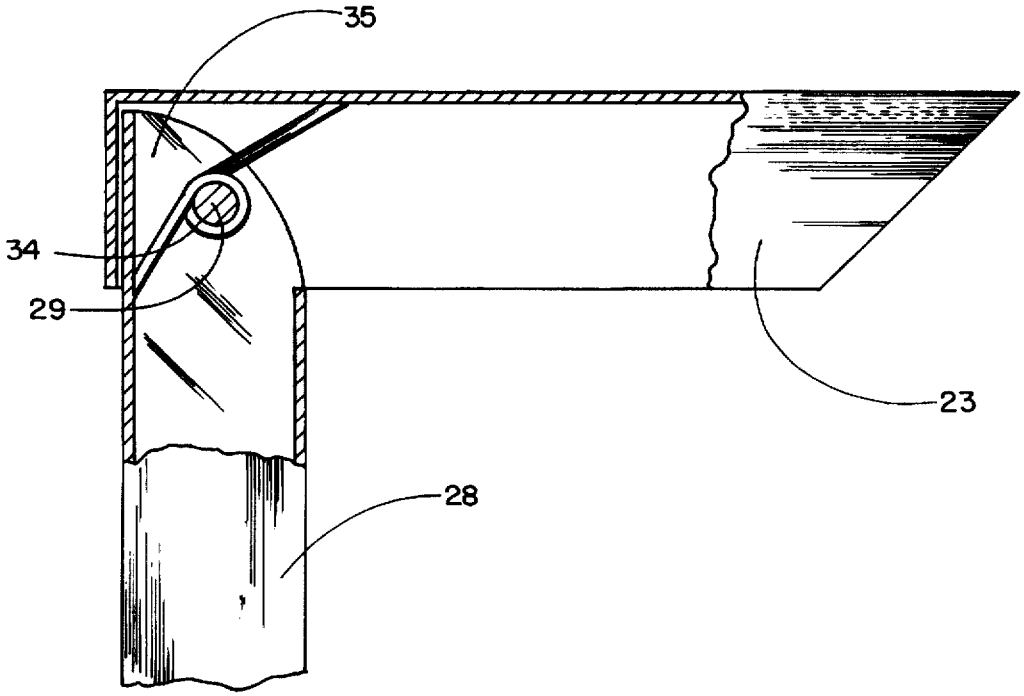
FIG. 6 is a side sectional view thereof with the rear leg in a downward, substantially vertical position.

Each rear leg 17, as previously indicated, is pivotally mounted so as to be movable between a downward, substantially vertical position as shown in FIG. 3 and an upward, inoperative position as shown in FIG. 2 in which rear leg 17 is folded against the underside of track 42 and extends between the walls of channel member 23. Rear leg 17 is biased to the downward position by a torsion spring 34 journalled about pivot pin 29. The movement of rear leg 17 toward the downward position is stopped when the tip 35 of upper leg portion 28 engages the top channel member 23 as can be clearly seen in FIG. 6.

Turning to FIG. 3, the front cover 40 is attached to a slide member 45 and is moveable between a storage position shown in FIG. 1 and a covering position shown in FIG. 2. In the storage position, front cover 40 is positioned underneath and adjacent bottom 18 of ash pan 15. Tracks 42 form a channel 44 beneath bottom 18 in which the cover 40 slides between the storage position and covering position.

Cover 40 is attached by a hinge 46 to a slide member 45 which slides back and forth in tracks 42. The cover 40 includes first and second sections 47 and 49 which are connected by a hinge 48. To place top 40 in the covering position, front cover 40 is first pulled out from beneath ash pan 15. A stop 51 located in the track 42 prevents cover 40 from being completely removed from the track 42. Front cover 40 is then lifted so that the first section 47 assumes a vertical position adjacent the front wall 19 of the ash pan 15 and the second section 49 overlies the open top of the ash pan 15. Preferably, the side walls 21 include an inwardly projecting flange along the upper edge thereof to eliminate the gap between the cover 40 and the top edge of the side walls 21.

As shown in FIG. 3, rear wall 20 is connected to the bottom of the ash pan 15 by a hinge 54. Hinge 54 allows the rear wall 20 of ash pan 15 to be pivoted between open and closed positions. When in the open position, the rear wall 20 is rotated rearwardly and hangs downwardly from the bottom 18 of the ash pan 15 so that a rear wall opening 56 is formed in the ash pan 15. Rear wall 20 is placed in the open position so that ashes collected in ash pan 15 can easily be swept through the wall opening 56 and out of ash pan 15. The rear cover 50 is fixedly secured to the top edge of the rear wall 20 approximately ⅕ the distance of the front wall 19.

In the preferred embodiment, latches 58 are used to detachably secure the rear wall 20 of the ash pan 15 in the closed position. Latches 58 are attached to opposite sides of the flange 50 which extends from the rear wall 20. Latches 58 are resilient and press against the side walls 21 to lock rear wall 20 in the closed position.

In operation, to collect ashes from woodstove 11 the ash catcher 10 of the present invention is positioned so that cover 40 is placed in its storage position beneath ash pan 15 and the rear wall 20 is in its closed position. The ash catcher 10 is then extended underneath the outwardly extending ledge 14 of the associated woodstove 11. The rear legs 17 are folded upwardly against the underside of ash pan 15 so that channel member 23 rests upon the hearth 13 of fireplace 12. It is understood that in so placing ash catcher 10, the rear legs 17 will be moved into its upward inoperative position when it engages the hearth 13 while the ash catcher is being positioned.

The ash catcher 10 allows ash and other debris to be swept from the woodstove 11 over ledge 14 and into ash pan 15 without spilling the same onto the hearth 13. When full, the cover 40 of ash catcher 10 is pulled from beneath the ash pan 15 and folded upwardly to overly the top of the ash pan 15. With the top covering ash pan 15, ash catcher 10 can be moved without ashes spilling out of the ash pan 15. The ash catcher 10 is moved by grasping handles 22 and carrying ash catcher 10 to a remote location. When the ash catcher 10 is lifted away from hearth 13, rear leg 17 will of course be urged into its downward position enabling ash catcher 10 to be set down in freestanding fashion when not in use.

Once ash catcher 10 has been carried to the site of disposal, the cover 40 is moved back to its storage position. The rear wall 20 of ash pan 15 is unlatched and moved to an open position in which the rear wall 20 hangs downwardly from its hinged attachment to the bottom 18 of ash pan 15. Placing rear wall 20 in its open position results in a rear wall opening 56 being formed in ash pan 15. Ashes stored in the ash catcher 10 can then be swept through the rear wall opening 56 of ash pan 10 and into an appropriate receptacle.

From the foregoing, it is apparent that the ash catcher 10 of the present invention provides a simple and efficient means for removing ash from a woodstove 11. In addition, ash catcher 10 provides an effective means for transporting the ash catcher 10 when it contains ashes such that no ashes are spilled when carrying the ash catcher 10. Finally, ash catcher 10 provides an effective means for allowing ashes contained therein to be easily swept into a receptacle.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An ash catcher for use in connection with a woodstove adapted to be inserted into a fireplace, said fireplace having a raised hearth, said woodstove having an outwardly extending ledge defining an open space between said ledge and the top of said hearth, comprising: an open top pan including a bottom and a surrounding wall structure, said surrounding wall structure having a rear wall, a front wall and side walls connecting opposite ends of said front and rear walls; hearth engaging means for supporting the rear portion of said pan on said hearth such that said rear wall extends into said open space between said ledge and said hearth; a pair of legs for supporting the front portion of said pan; at least one rear leg pivotally secured to said pan and movable between a retracted position in which said rear leg is folded against the underside of said pan when said pan is in engagement with said hearth and a downward, substantially vertical position for supporting the rear portion of said pan is not in engagement with said hearth; means for biasing said rear leg to said downward position such that when said pan is removed from said hearth said rear leg automatically assumes a downward position; a retractable cover slidably attached to the ash pan and moveable between a closed position and a storage position, wherein the cover overlies the pan to prevent spillage of ashes contained in the pan when placed in the closed position, and wherein the cover is disposed below and approximately parallel to the bottom of the pan when the cover is in the storage position.

2. The ash catcher of claim 1 wherein said hearth engaging means includes a downwardly opening channel secured to the rear portion of said pan and wherein said rear leg is pivotally secured to said channel member by means of a pivot pin such that when said rear leg assumes a retracted position, the same extends between the walls of said channel.

3. The ash catcher of claim 2 wherein said biasing means includes a torsion spring journalled about said pivot pin interiorly of said rear leg, said torsion spring having one arm bearing against the underside of said pan and one arm bearing against the interior of said rear leg.

4. The ash catcher of claim 1 wherein said front legs each include an upper leg portion fixedly secured to said pan, a lower leg portion slidingly mounted in said upper leg portion and means for fixing said lower leg portion in at least two different positions relative to said upper leg portion whereby the length of said front legs can be adjusted.

5. The ash catcher of claim 1 wherein said pan further includes a pair of U-shaped handles secured to opposite sidewalls to facilitate lifting and carrying of said ash pan.

6. The ash catcher of claim 1 wherein at least one of the walls of the wall structure of the pan is positionable between a closed position where the wall structure is enclosed for containing ashes and an open position where a wall opening is formed in the wall structure through which ashes contained in the pan can be swept through.

7. The ash catcher of claim 6 wherein the rear wall is positionable between open and closed positions.

8. The ash catcher of claim 6 wherein the wall positionable between open and closed positions is hingedly attached to the bottom of the pan.

9. An ash catcher for use in connection with a wood stove adapted to be inserted into a fireplace having a raised hearth comprising: an open top pan including a bottom and a surrounding wall structure; hearth engaging means for supporting the rear portion of said pan on said hearth and adjacent to said woodstove; a pair of legs for supporting the front portion of said pan; and at least one leg secured to said rear portion of said pan and movable between a retracted position when said pan is in engagement with said hearth and a downward, substantially vertically position for supporting said rear portion of said pan when said pan is not in engagement with said hearth; means for biasing said rear leg to said downward position such that when said pan is removed from said hearth, said rear leg automatically assumes a downward position; a retractable cover slidably attached to the ash catcher and moveable between a closed position and a storage position wherein the cover overlies the pan to prevent spillage of ashes contained in the pan when the cover is in the closed position, and wherein the cover is substantially disposed below and approximately parallel to the bottom of the pan when the cover is in the storage position.

10. The ash catcher of claim 9 wherein said hearth engaging means includes a downwardly opening channel secured to the rear portion of said pan and wherein said rear leg is pivotally secured to said channel member such that when said rear leg assumes a retracted position, the same extends between the walls of said channel.

11. The ash catcher of claim 9 wherein said front legs each include an upper leg portion fixedly secured to said pan, a lower leg portion slidingly mounted within said upper leg portion and means for fixing said lower leg portion in at least two different positions relative to said upper leg portion whereby the length of said front legs can be adjusted.

12. The ash catcher of claim 9 wherein said pan further includes a pair of handles secured to said surrounding wall structure to facilitate lifting and carrying of said ash pan.

13. The ash catcher of claim 9 wherein at least one of the walls of the wall structure of the pan is positionable between a closed position where wall structure is enclosed for containing ashes and an open position where a wall opening is formed in the wall structure through which ashes contained in the pan can be swept through.

14. The ash catcher of claim 13 wherein the rear wall is positionable between open and closed positions.

15. The ash catcher of claim 13 wherein the wall positionable between open and closed positions is hingedly attached to the bottom of the pan.

16. An ash catcher for use in connection with a woodstove adapted to be inserted into a fireplace, said fireplace having a raised hearth, said woodstove having an outwardly extending ledge defining an open space between said ledge and the top of said hearth, comprising: an open top pan including a bottom and a surrounding wall structure, said surrounding wall structure having a rear wall, a front wall and side walls connecting opposite ends of said front and rear walls; wherein at least one of the walls of the wall structure of the pan is moveable between a closed position where the wall structure is enclosed for containing ashes and an open position where a wall opening is formed in the wall structure through which ashes contained in the pan can be swept through hearth engaging means for supporting the rear portion of said pan on said hearth such that said rear wall extends into said open space between said ledge and said hearth; a pair of legs for supporting the front portion of said pan; at least one rear leg pivotally secured to said pan and movable between a retracted position in which said rear leg is folded against the underside of said pan when said pan is in engagement with said hearth and a downward, substantially vertical position for supporting the rear portion of said pan when said pan is not in engagement with said hearth; and means for biasing said rear leg to said downward position such that when said pan is removed from said hearth said rear leg automatically assumes a downward position; a retractable top slidably attached to the ash catcher and positionable between open and closed positions, wherein the top covers the pan to prevent spillage of ashes contained in the pan when the top is in the closed position, and wherein the top is substantially disposed below and approximately parallel to the bottom of the pan when the top is in the open position.

17. The ash catcher of claim 16 wherein the rear wall is positionable between open and closed positions.

18. The ash catcher of claim 16 wherein the wall positionable between open and closed positions is hingedly attached to the bottom of the pan.

19. An ash catcher for use in connection with a woodstove adapted to be inserted into a fireplace comprising:

a) an open top pan including a bottom and a surrounding wall structure;

b) a plurality of legs for supporting said pan;

c) a storage space disposed below, and generally parallel to, said bottom;

d) a retractable cover slidably attached to said pan and movable between a closed position in which said cover at least partially encloses said open top pan, and a storage position in which said cover is retracted into said storage space.

* * * * *